US010000311B1

(12) United States Patent
Oliver

(10) Patent No.: US 10,000,311 B1
(45) Date of Patent: Jun. 19, 2018

(54) METHOD AND APPARATUS FOR CONSTRUCTING PALLETS

(71) Applicant: Victor Oliver, Elizabethton, TN (US)

(72) Inventor: Victor Oliver, Elizabethton, TN (US)

( * ) Notice: Subject to any disclaimer, the term of this patent is extended or adjusted under 35 U.S.C. 154(b) by 0 days. days.

(21) Appl. No.: 15/658,463

(22) Filed: Jul. 25, 2017

Related U.S. Application Data

(63) Continuation-in-part of application No. 15/408,528, filed on Jan. 18, 2017.

(51) Int. Cl.
*B65D 19/38* (2006.01)
*B65D 19/00* (2006.01)

(52) U.S. Cl.
CPC ..... *B65D 19/0095* (2013.01); *B65D 2519/00029* (2013.01); *B65D 2519/00273* (2013.01); *B65D 2519/00293* (2013.01); *B65D 2519/00333* (2013.01); *B65D 2519/00572* (2013.01)

(58) Field of Classification Search
CPC ..... B65D 19/14; B65D 2519/00029; B65D 2519/00273; B65D 2519/00293; B65D 2519/00547; B65D 2519/00572; B65D 2519/00333
USPC ... 108/54.1, 56.1, 56.3, 57.17, 57.19, 57.21, 108/57.24
See application file for complete search history.

(56) References Cited

U.S. PATENT DOCUMENTS 1,766,316 A * 6/1930 Vance ..... E04H 3/12 403/389
2,503,022 A * 4/1950 Benoist ..... B65D 19/0095 108/56.1
2,739,776 A * 3/1956 Terando ..... B65D 19/0002 108/54.1
2,783,960 A * 3/1957 Herz ..... B65D 19/0069 108/56.1
4,184,435 A * 1/1980 Shevchenko ..... B65D 19/0069 108/57.1
4,359,948 A * 11/1982 Judy ..... B65D 19/0075 108/56.1
4,438,603 A * 3/1984 Durkan, Jr. ..... A47C 1/12 297/232
4,694,962 A * 9/1987 Taub ..... B65D 19/0073 108/185
5,676,067 A * 10/1997 Breindel ..... B65D 19/0002 108/180
6,234,086 B1 * 5/2001 Mason ..... B65D 19/0002 108/51.11
6,257,164 B1 * 7/2001 Carey, II ..... B63B 35/34 114/263

(Continued)

*Primary Examiner* — Hanh V Tran
(74) *Attorney, Agent, or Firm* — Luedeka Neely Group, P.C.

(57) ABSTRACT

A pallet, including a plurality of spaced apart stringers defining a pallet width and a plurality of slats extending lengthwise across the stringers corresponding to the pallet width, and at least two of the slats have a length that is less than the pallet width and define undersized slats. A slat splice connector bridging between adjacent ones of the undersized slats so that the undersized slats are spliced together to provide a spliced slat having a length corresponding to the pallet width, the slat splice connector having an elevated surface between and supported by a pair of spaced apart legs, with the undersized slats of the spliced slat supported by and attached to the legs of the slat splice connector.

6 Claims, 4 Drawing Sheets

(56) References Cited

U.S. PATENT DOCUMENTS

| | | | | |
|---|---|---|---|---|
| 8,087,364 | B2 * | 1/2012 | Huang-Jung | B65D 19/0097 108/56.1 |
| 2005/0072700 | A1 * | 4/2005 | Sutt, Jr. | B65D 19/38 206/338 |
| 2006/0075938 | A1 * | 4/2006 | Meissen | B65D 19/38 108/54.1 |
| 2008/0035033 | A1 * | 2/2008 | Liebel | B65D 19/0026 108/56.1 |
| 2008/0066657 | A1 * | 3/2008 | Kuo | B65D 19/0095 108/57.19 |
| 2009/0188412 | A1 * | 7/2009 | Dubois | B65D 19/0022 108/57.25 |
| 2010/0229765 | A1 * | 9/2010 | Shafer | B65D 19/0095 108/57.17 |
| 2016/0137342 | A1 * | 5/2016 | Liao | B65D 19/0095 108/54.1 |

* cited by examiner

METHOD AND APPARATUS FOR CONSTRUCTING PALLETS

CROSS-REFERENCE TO RELATED APPLICATION

This application is a continuation-in-part of co-pending (Allowed) U.S. application Ser. No. 15/408,528 filed Jan. 18, 2017, entitled METHOD AND APPARATUS FOR CONSTRUCTING PALLETS.

FIELD

This disclosure relates to the field of pallets. More particularly, this disclosure relates to methods and apparatus for constructing pallets utilizing undersized slats.

BACKGROUND

Improvement is desired in the construction of pallets, especially construction of pallets from recycled materials.

Pallets include as major components interior supports known as stringers, onto which are applied slats to provide a surface for receiving a load. During use, pallets or at least portions thereof, can break. Most often, the slats break as their thickness is less than that of the stringers.

Badly broken pallets are often taken apart to salvage non-broken components to use to make pallets from the used materials, or to repair broken pallets. Typically, broken slats are burned or otherwise disposed of. That is, if a recovered slat is undersized, it is considered to be unusable. This represents a waste and often an expense.

The present disclosure relates to pallets and methods for manufacturing pallets utilizing undersized slats.

SUMMARY

The disclosure relates to pallets and methods for manufacturing pallets utilizing undersized slats.

In one aspect, the disclosure relates to a pallet including a plurality of spaced apart stringers defining a pallet width and a plurality of slats extending lengthwise across the stringers corresponding to the pallet width, and at least two of the slats have a length that is less than the pallet width and define undersized slats.

A slat splice connector bridging between adjacent ones of the undersized slats so that the undersized slats are spliced together to provide a spliced slat having a length corresponding to the pallet width, the slat splice connector having an elevated surface between and supported by a pair of spaced apart legs, with the undersized slats of the spliced slat supported by and attached to the legs of the slat splice connector.

In another aspect, the disclosure relates to a method for manufacturing pallets. The method includes the step of providing a plurality of spaced apart stringers defining a pallet width and a plurality of slats extending lengthwise across the stringers corresponding to the pallet width, wherein a plurality of the slats each have a length that is less than the pallet width and define undersized slats.

The method steps also include providing a slat splice connector and installing the slat splice connector to bridge between adjacent ones of the undersized slats so that the undersized slats are spliced together to provide a spliced slat having a length corresponding to the pallet width and coplanar with the slats to define a planar upper load support surface of the pallet. The slat splice connector includes an elevated surface between and supported by a pair of spaced apart legs. The undersized slats of the spliced slat are supported by and attached to the legs of the slat splice connector.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
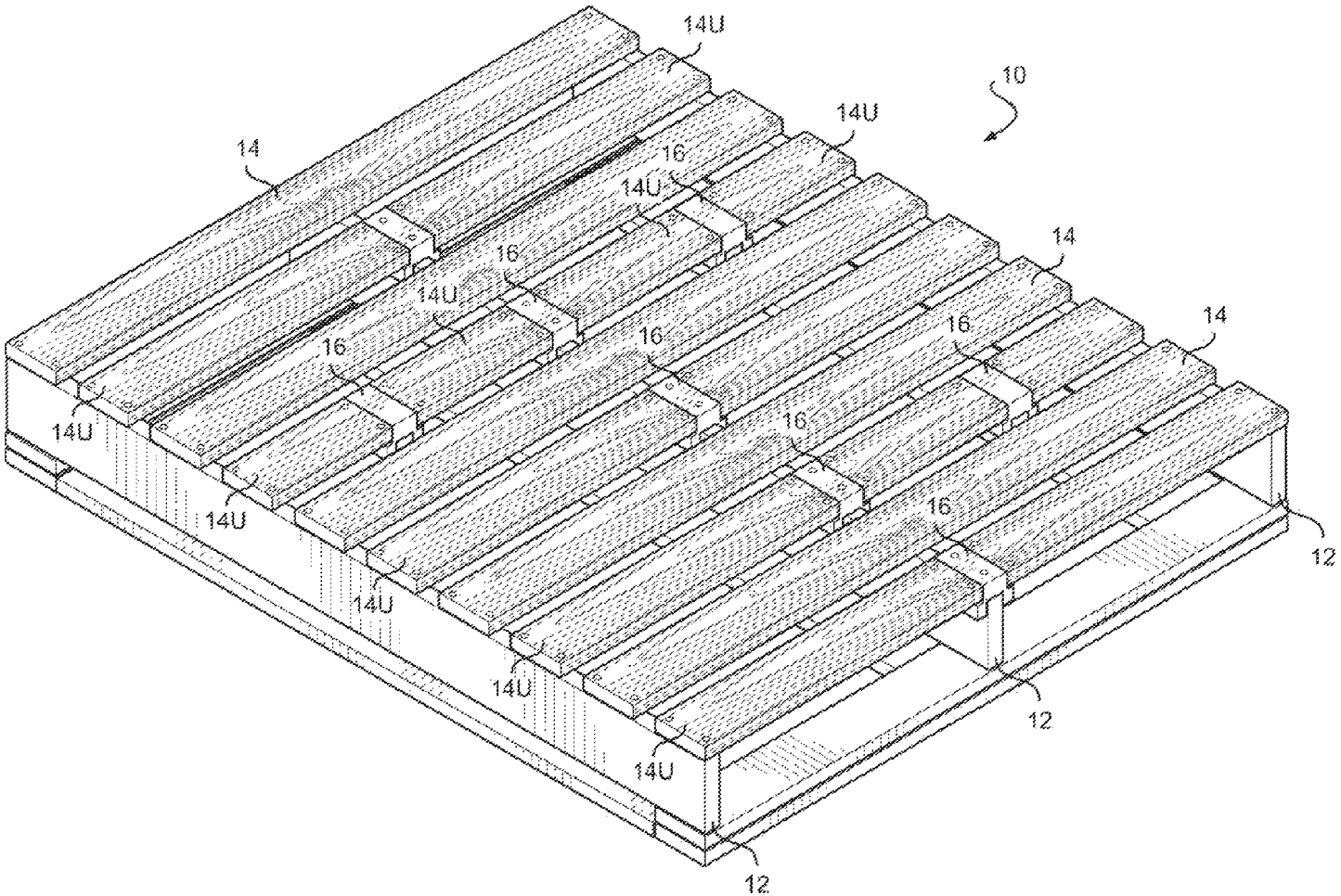
FIG. 1 shows an assembled pallet according to the disclosure.

With reference to the drawings, there is shown a pallet 10. The pallet 10 may be one-or two sided and may have additional support components. The primary features of the pallet relate to the pallet 10 having a plurality of stringers 12 supporting a plurality of slats 14. In accordance with the disclosure, some of the slats 14 are undersized, in that at least some of the slats 14 are shorter in length and do not extend across the entire width of the pallet 10. The undersized slats are designated by reference numeral 14U. The pallet 10 incorporates slat splice members 16 to splice between the undersized slats 14U.

The components of the pallet 10 are generally made of wood, but one or more or all of the components thereof may be made of other materials such as wood, plastic, and composites and the like.

The pallet 10 may be configured in various sizes. However, for the purpose of example, the pallet 10 is shown and described as being a standard US sized pallet having a length of about 48 inches and a width of about 40 inches. Conventionally, the slats 14 of such a pallet will each have a length of 40 inches.

During use, pallets or at least portions thereof, can break. Most often, the slats break more often as their thickness is less than that of the stringers. Badly broken pallets are typically taken apart to salvage non-broken components to use to make pallets from the used materials, or to repair broken pallets. Typically, broken slats are burned or otherwise disposed of. If a recovered slat is less than 40 inches in length so as to be undersized, it is considered to be unusable. A broken slat therefore represents an undersized slat. The present disclosure is particularly suitable for the manufacture of pallets from undersized slats.

For the purpose of example, the stringers 12 are provided by boards having a length of 48 inches, a width of 3.5 inches, and a thickness of 1⅜ inches. The slats 14 are provided by boards having a length of 40 inches, a width of between about 3.5 and 5.5 inches, and a thickness of ⅝ inches. The undersized slats 14U are the same as the slats 14, except they each have a length less than 40 inches. Most preferred, the undersized slats 14U preferably extend to the midpoint of the pallet 10 and each have a length of about 19 inches. But, as seen, even shorter boards may be used for the undersized slats 14U.

The slat splice members 16 are configured to splice between the undersized slats 14U, and provide a flat upper surface between the ends of the undersized slats 14U connected together by the splice member 16. Thus, the splice members 16 enable the undersized slats 14U to be joined in a manner to provide a structure that may be used in place of the slats 14, and reducing cost and waste associated with conventional construction of pallets made with used components and conventional repair of pallets.

Figure 4:
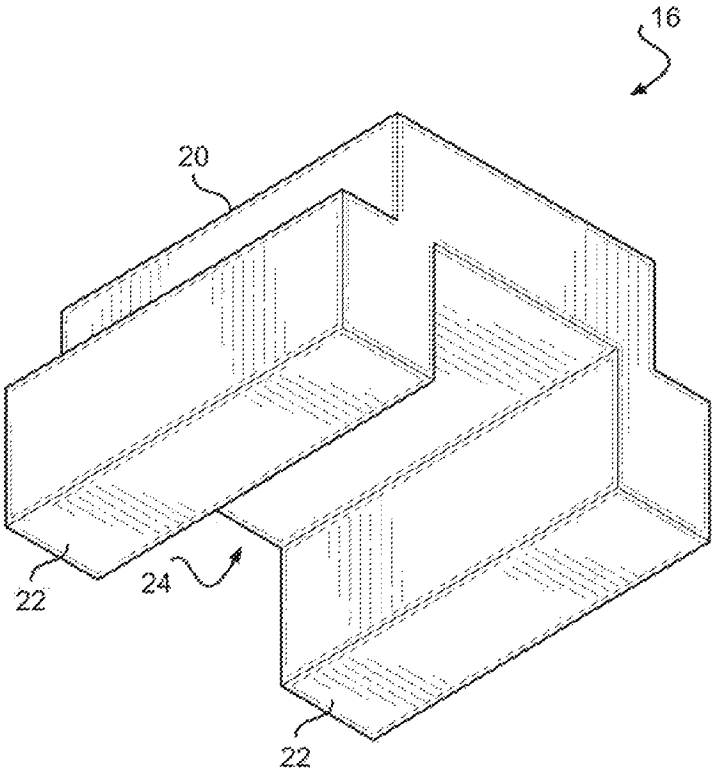
FIG. 4 is a lower perspective view of the slat splice member of FIG. 3.
Figure 3:
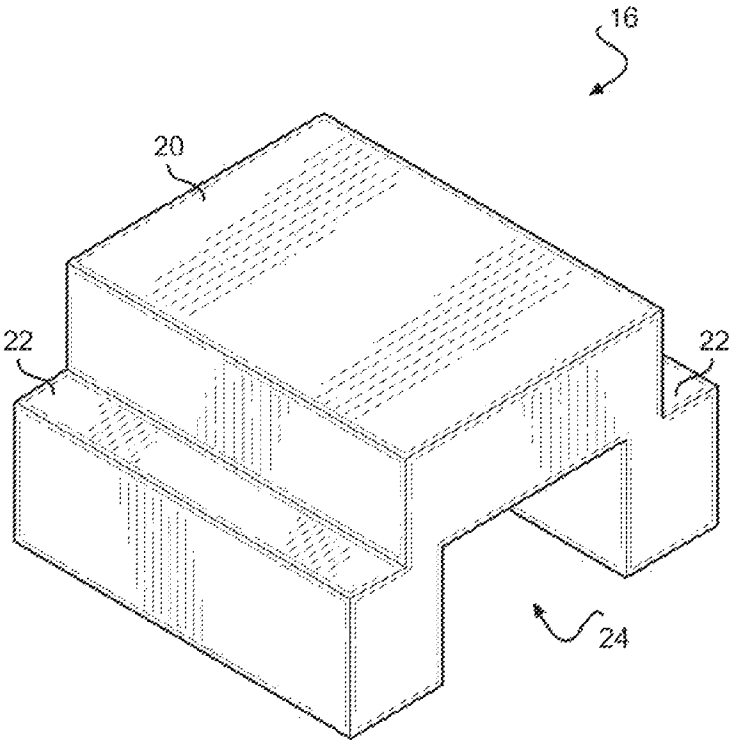
FIG. 3 is an upper perspective view of a slat splice member utilized in the pallet of FIG. 1.
Figure 5:
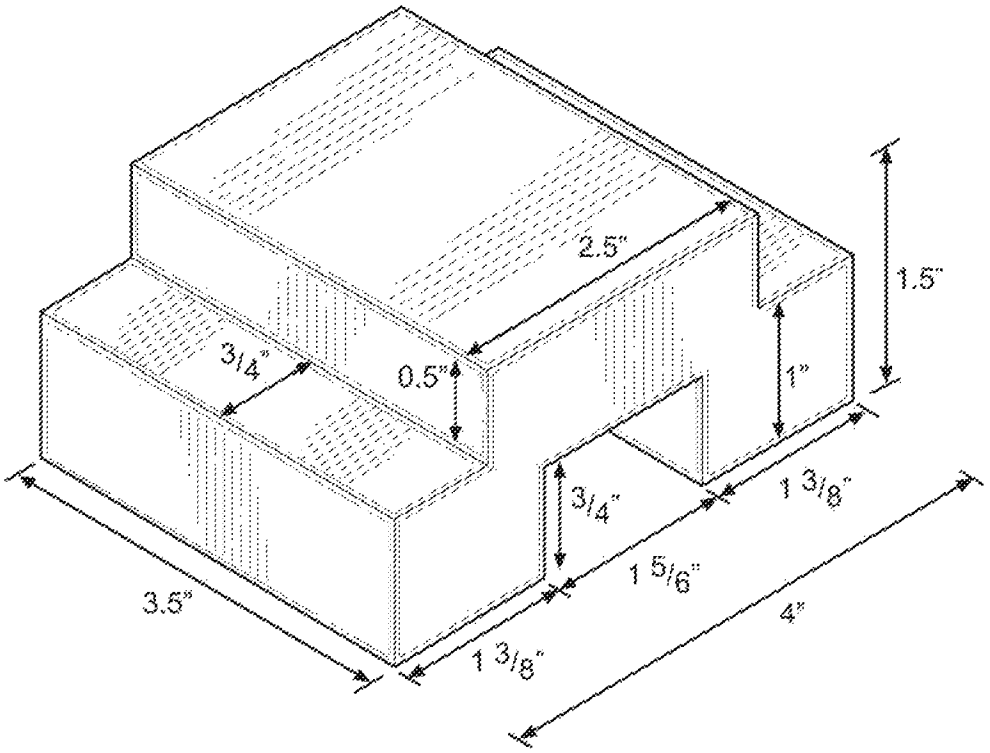
FIG. 5 shows preferred dimensions of the slat splice member as configured for construction of 40 inch by 48 inch pallets.

Turning to FIGS. 3 and 4, the splice members 16 are configured to sit atop the stringers 12 and to bridge between the undersized slats 14U. In this regard, the splice members 16 are configured to have an elevated surface 20 between and supported by a pair of spaced apart legs 22, which define a channel 24 therebetween. For use with the stringers 12 and the undersized slats 14U dimensioned as described above, the splice members are dimensioned as shown in FIG. 5.

Figure 2:
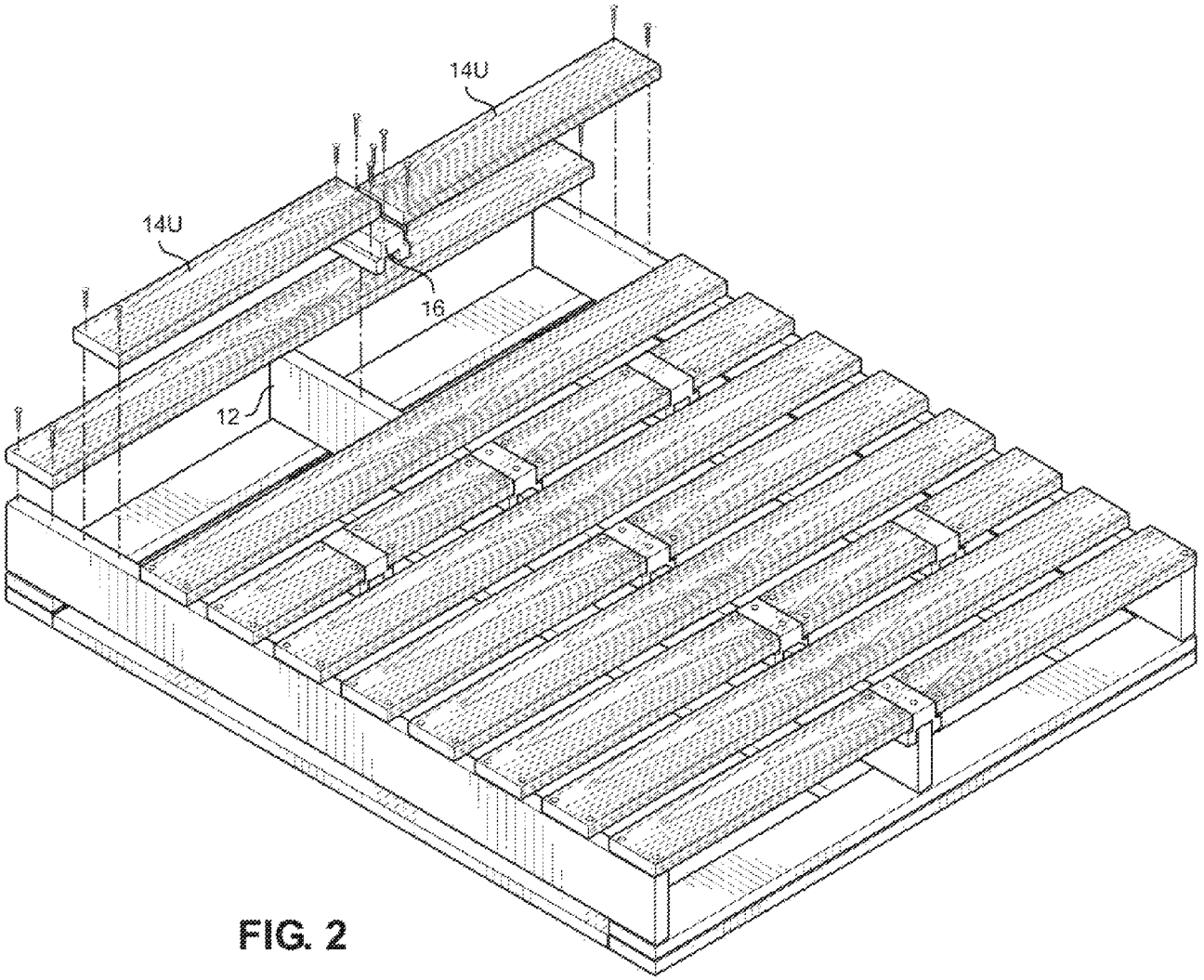
FIG. 2 is a partially exploded view of the pallet of FIG. 1.

As seen in FIGS. 1 and 2, the splice member 16 may be installed onto one of the stringers 12, with the channel 24 seated onto the stringer 12. When the splice member 16 is installed on the stringer 12, the legs 22 of the splice member 16 are on either side of the stringer 12, and the elevated surface 20 overlies the stringer 12.

The undersized slats 14U utilized with the splice members 16 are provided by broken slats recovered from a pallet. The broken end of the recovered slat is preferably sawn to provide one of the undersized slats 14U. Most desirably, the undersized slats 14U are cut to each have a length of about 19 inches. This enables positioning of the splice member 16 on the stringer 12 located at the middle of the pallet 10.

One of the undersized slats 14U is positioned on either side of and abutting the elevated surface 20, and overlying one of the legs 22 of the splice member 16. Fasteners, such as nails, screws, adhesive or the like are then applied to secure the splice member 16 to the stringer 16, and the ends of the undersized slats 14U to the legs 22. As will be observed, the elevated surface 20 and the upper surfaces of the undersized slats 14U are coplanar to provide a flat upper load support surface corresponding to the upper load support surface provided by the slats 14.

In addition, as also seen in FIGS. 1 and 2, it will be appreciated that the splice members 16 may be utilized to join together the undersized slats 14U at locations intermediate the stringers 12. For such applications, the splice members 16 may be made without the channel 24. This enables recycling of broken slats having a length of less than about 19 inches.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A pallet, comprising:

a plurality of spaced apart stringers defining a pallet width and a plurality of slats extending lengthwise across the stringers corresponding to the pallet width, and at least two of the slats have a length that is less than the pallet width and define undersized slats; and a slat splice connector bridging between adjacent ones of the undersized slats so that the undersized slats are spliced together to provide a spliced slat having a length corresponding to the pallet width, the slat splice connector comprising: an elevated surface between and supported by a pair of spaced apart legs, and a channel between the legs configured to receive one of the stringers of the pallet, wherein the undersized slats of the spliced slat are supported by and attached to the legs of the slat splice connector.

2. The pallet of claim 1, wherein the pallet width is about 40 inches and the undersized slats each have a length of about 19 inches or less.

3. The pallet of claim 1, wherein the undersized slats and the slat splice connector are made of wood.

4. A method for manufacturing pallets, comprising the steps of:

providing a plurality of spaced apart stringers defining a pallet width and a plurality of slats extending lengthwise across the stringers corresponding to the pallet width, wherein a plurality of the slats each have a length that is less than the pallet width and define undersized slats; and providing a slat splice connector and installing the slat splice connector to bridge between adjacent ones of the undersized slats so that the undersized slats are spliced together to provide a spliced slat having a length corresponding to the pallet width and coplanar with the slats to define a planar upper load support surface of the pallet, the slat splice connector comprising: an elevated surface between and supported by a pair of spaced apart legs, and a channel between the legs configured to receive one of the stringers of the pallet, wherein the undersized slats of the spliced slat are supported by and attached to the legs of the slat splice connector and the one of the stringers is received by the channel of the slat splice connector.

5. The method of claim 4, wherein the pallet width is about 40 inches and the undersized slats each have a length of about 19 inches or less.

6. The method of claim 4, wherein the undersized slats and the slat splice connector are made of recycled wood.

* * * * *